US007481603B1

(12) United States Patent
Fox

(10) Patent No.: US 7,481,603 B1
(45) Date of Patent: Jan. 27, 2009

(54) TENSIONABLE SPIRAL BOLT WITH RESIN NUT AND RELATED METHOD

(75) Inventor: William G. Fox, White Plains, KY (US)

(73) Assignee: Shelter Technologies, LLC, White Plains, KY (US)

( * ) Notice: Subject to any disclaimer, the term of this patent is extended or adjusted under 35 U.S.C. 154(b) by 0 days.

(21) Appl. No.: 11/539,654

(22) Filed: Oct. 9, 2006

Related U.S. Application Data

(60) Provisional application No. 60/724,683, filed on Oct. 7, 2005.

(51) Int. Cl.
*E21D 20/00* (2006.01)

(52) U.S. Cl. ..... 405/259.5; 405/259.1

(58) Field of Classification Search ..... 405/259.1, 405/259.5, 259.6, 302.1
See application file for complete search history.

(56) References Cited

U.S. PATENT DOCUMENTS

| | | | | | |
|---|---|---|---|---|---|
| 4,062,229 | A * | 12/1977 | Godfrey et al. | ..... | 73/582 |
| 4,100,748 | A | 7/1978 | Hansen | | |
| 4,132,080 | A | 1/1979 | Hansen | | |
| 4,295,761 | A | 10/1981 | Hansen | | |
| 4,305,687 | A | 12/1981 | Parker | | |
| 4,307,979 | A * | 12/1981 | Killmeyer | ..... | 405/259.1 |
| 4,325,657 | A * | 4/1982 | Elders | ..... | 405/259.1 |
| 4,386,877 | A | 6/1983 | McDowell, Jr. | | |
| 4,564,315 | A * | 1/1986 | Rozanc | ..... | 405/259.6 |
| 4,618,290 | A | 10/1986 | Hansen | | |
| 4,642,964 | A | 2/1987 | Kellison | | |
| 4,662,795 | A * | 5/1987 | Clark et al. | ..... | 405/259.6 |
| 4,746,248 | A * | 5/1988 | Lillis et al. | ..... | 405/259.5 |
| 5,013,192 | A | 5/1991 | Scott | | |
| 5,234,291 | A | 8/1993 | Swemmer | | |
| 5,253,964 | A | 10/1993 | Swemmer | | |
| 5,273,377 | A * | 12/1993 | Taylor | ..... | 405/259.6 |
| 5,282,698 | A * | 2/1994 | Wright et al. | ..... | 405/259.6 |
| 5,387,060 | A * | 2/1995 | Locotos | ..... | 405/259.6 |
| 5,544,981 | A * | 8/1996 | Nishida et al. | ..... | 405/259.6 |
| 5,688,077 | A * | 11/1997 | Kynoch | ..... | 405/259.5 |
| 5,827,014 | A | 10/1998 | Swemmer | | |
| 6,698,980 | B2 | 3/2004 | Mongrain | | |
| 6,874,975 | B2 * | 4/2005 | Hilfiker et al. | ..... | 405/262 |
| 2004/0109729 | A1 * | 6/2004 | Hilfiker et al. | ..... | 405/259.1 |

* cited by examiner

*Primary Examiner*—Frederick L Lagman
(74) *Attorney, Agent, or Firm*—King & Schickli, PLLC

(57) ABSTRACT

In one aspect of the invention, an apparatus and related methods for installation in a borehole formed in a face of a mine passage comprises an elongated bolt including a spiral shaft portion for positioning in the borehole. A hardened, stationary resin nut formed in only part of the borehole, preferably spaced from the distal end thereof, receives the spiral shaft portion of the bolt. Consequently, rotation of the spiral shaft portion within the hardened resin nut serves to move the bolt within the borehole, such as for purposes of tensioning.

25 Claims, 4 Drawing Sheets

TENSIONABLE SPIRAL BOLT WITH RESIN NUT AND RELATED METHOD

This application claims the benefit of U.S. Provisional Patent App. Ser. No. 60/724,683, filed Oct. 7, 2005, the disclosure of which is fully incorporated herein by reference.

TECHNICAL FIELD

The present inventions relate generally to providing support for a face of a passage in a geological structure and, more particularly, to a tensionable spiral bolt associated with a resin nut partially occupying a borehole and related methods.

BACKGROUND OF THE INVENTION

In recent decades, a number of proposals for supporting the face of a passage in a geological structure, such as the roof in an underground mine, have been made. The typical arrangement employs an anchor, such as an elongated roof "bolt," that extends into a borehole formed in the face. Federal regulations pertaining to underground mine safety require the placement of these bolts at frequent intervals throughout the mine passage. Consequently, ease of manufacture and use are critical factors in terms of reducing the overall installation cost to the mine owner (which directly correlates to the profitability of the mining operation).

Of course, one of the major areas for lowering the manufacturing cost and installation time for such bolts involves reducing the diversity, complexity, and overall number of the parts required. This includes eliminating the need for specialized expansion shells, external nuts, or other attachments to the bolt required in the past to effect proper tensioning. Extensive processing of the bolt shaft typically necessary for accommodating these types of expansion shells or external nuts should also be eliminated, since this activity not only increases manufacturing time and expense, but also tends to weaken the bolt and the resulting assembly.

Accordingly, a need exists for an improved bolting apparatus that overcomes the foregoing limitations of the prior art. Specifically, the bolt should be easy and inexpensive to manufacture and install. The bolt would be also be tensionable to compress and provide secure, reliable support for the adjacent strata once installed.

SUMMARY OF THE INVENTION

In accordance with one aspect of the invention, an apparatus for installation in a borehole formed in a face of a mine passage is disclosed. The apparatus comprises an elongated bolt including a spiral shaft portion for positioning in the borehole. A stationary, hardened resin nut is formed in a portion of the borehole for surrounding at least part of the spiral shaft portion of the bolt. Rotation of the spiral shaft portion within the resin nut thus serves to move the bolt within the borehole, such as during tensioning.

In one embodiment, the spiral shaft portion comprises a generally square cross section, and may include approximately 1-2 twists for about every foot in the longitudinal direction. To facilitate rotation within the resin nut, at least part of the spiral portion may include a lubricity or rust-inhibiting agent. Preferably, a colored agent is also applied along at least part of the spiral shaft portion to allow for identification of the bolt for use with the resin nut.

The bolt may include a head end and a tail end as well. The tail end for advancing into the borehole may include a taper or point. Preferably, the construction of the bolt is such that it is formed of a single piece of material. A flange may also be provided adjacent the head end, with one side for engaging a plate or like structure adjacent the mine face and the opposite side providing a bearing surface for a device or means for rotating the bolt.

In accordance with a second aspect of the invention, an apparatus for installation in a borehole formed in a face of a mine passage is disclosed. The apparatus comprises an elongated bolt including a portion, such as for example a spiral portion, for positioning in the borehole. A stationary, hardened resin nut is also provided for receiving a portion of the bolt. The apparatus further includes means for rotating the bolt relative to the hardened resin nut, preferably in the form of a drill head.

In accordance with a third aspect of the invention, an improvement is proposed for use in a borehole formed in a face of a mine passage for receiving a bolt having an elongated shaft for extending into the borehole. The improvement comprises a resin nut formed in a portion of the borehole and having an internal thread surrounding only a portion of the shaft. Preferably, the shaft of the bolt is spiral, whereby rotating the spiral shaft relative to the internal thread serves to tension the bolt.

In accordance with a fourth aspect of the invention, a roof bolt is proposed for insertion in a borehole formed in a face of a mine passage. The bolt comprises a shaft having a spiral portion at least partially having a coating selected from the group consisting of a lubricity agent, a rust-inhibiting agent, a colored agent and mixtures thereof. Preferably, the coating is at a distal end of the shaft having a point for insertion in the borehole.

In accordance with a fifth aspect of the invention, a method of tensioning a bolt including a spiral shaft portion in a borehole formed in a face of a mine passage is disclosed. The method comprises forming a stationary, hardened resin nut adjacent at least the spiral shaft portion of the bolt. The method further comprises rotating the spiral shaft portion relative to the hardened resin nut.

Preferably, the forming step comprises: (1) providing uncured resin within the borehole adjacent the spiral shaft portion of the bolt; (2) rotating the bolt in a first direction to substantially maintain the resin adjacent the spiral shaft portion; and (3) allowing the resin to substantially cure and form the hardened resin nut. Likewise, the step of rotating the bolt preferably comprises rotating the spiral shaft portion in a second direction opposite the first direction upon the substantial curing of the resin. In any case, the method may further include the step of applying a lubricity or rust-inhibiting agent to at least part of the spiral shaft portion.

In accordance with a fifth aspect of the invention, a method of installing an elongated bolt having a head end and a threaded or spiral portion in a face of a mine passage having a borehole is disclosed. The method comprises inserting the bolt at least partially within the borehole with the head end spaced from the opening. The bolt is rotated in a first direction and at least partially within an uncured resin within the borehole, and the resin is allowed to substantially cure and form a nut. The bolt is rotated in a second direction opposite the first direction such that the bolt moves through the resin nut with the head end moving closer to the opening of the borehole. Preferably, the head end of the bolt is initially spaced from the open end of the borehole, and the step of rotating the bolt in the second direction advances the head end of the bolt toward the open end of the borehole.

DETAILED DESCRIPTION OF THE INVENTION

Figure 1:
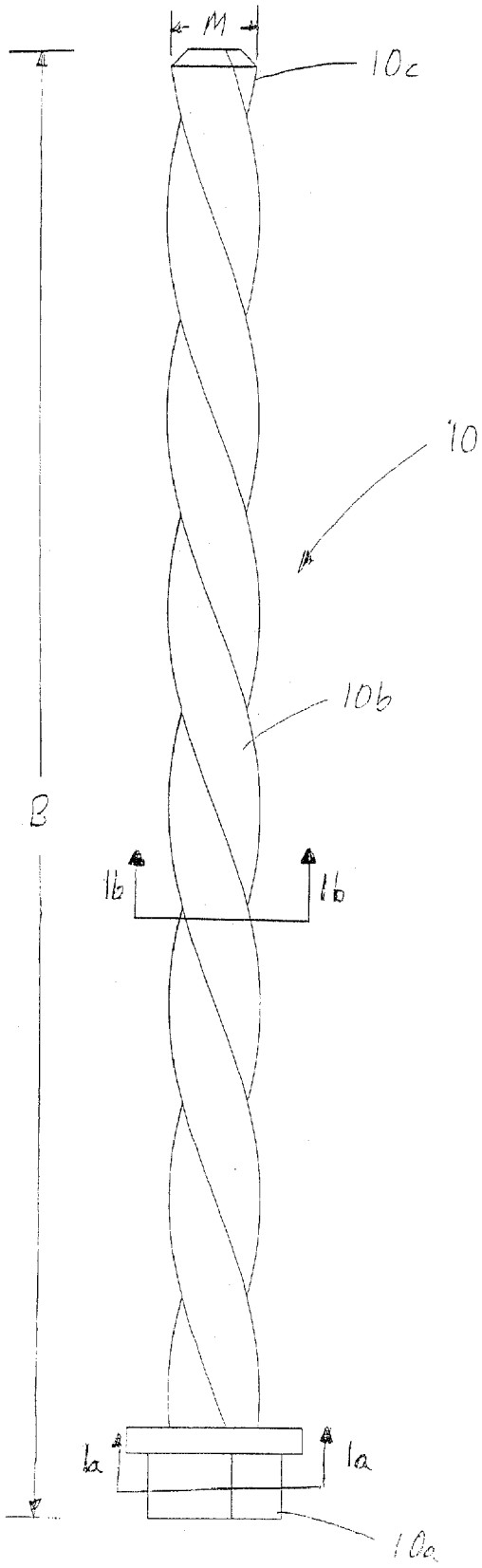
FIG. 1 is an elevational view, not to scale, of one possible embodiment of a roof bolt with a spiral portion.

Reference is now made to FIG. 1, which illustrates one embodiment of a bolt 10 for installation in a face F of a mine passage, such as the roof (see FIG. 2) having a borehole H formed vertically therein. Although the bolt 10 and related installation method are described as being used to reinforce and sustain a mine roof, it should be understood that the present invention may be applied to support any one of the other faces of the passage (e.g., a rib) or a different type of geological structure, without limitation.

Figure 1A:
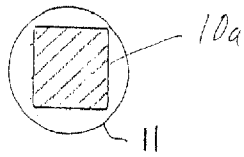
FIGS. 1*a* and 1*b* are cross-sections taken along lines 1*a*-1*a* and 1*b*-1*b* of FIG. 1, respectively.

As illustrated, the bolt 10 is preferably an elongated, one-piece structure comprising a head end 10*a*, an elongated body or shaft 10*b*, and a tail end 10*c*. As perhaps best understood with combined reference to FIGS. 1 and 1*a*, the head end 10*a* is adapted for being engaged by a wrench, chuck of a drill head (see FIG. 2), or like device or means for rotating the bolt 10 during installation. Despite being shown as having a portion with a generally square cross-section (FIG. 1*a*), it should be appreciated that the head end 10*a* of the bolt 10 may take on other cross-sectional shapes (e.g., hexagonal) without impacting the practice of the present invention in any meaningful way. An annular flange 11 is also provided adjacent the head end 10*a* to provide a bearing surface for the means for rotating on one side and the face or intervening structure (such as plate P; see FIG. 2) on the other.

Figure 1B:
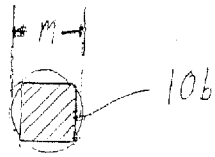

In accordance with one aspect of the invention, the shaft 10*b* of the bolt 10 is generally square in cross-section (see FIG. 1*b*), but is "twisted" along its length to form a spiral or helix. In the illustrated, preferred embodiment, the spiral extends along the entire length of the shaft 10*b* and is left-handed in nature (but could be the opposite as well). Although the number of spirals (twists) per foot (or pitch) of the bolt 10 is not essential to practice of the invention, the arrangement is preferably coarse in nature. For example, each foot of the spiral shaft 10*b* preferably includes between about 1 to 2 complete (e.g., 360°) twists. Most preferably, each complete twist occupies about seven inches of distance in the longitudinal direction, or length, which corresponds to about 1.7 complete twists per linear foot.

While it is easier in terms of manufacturing to provide a consistent spiral continuously along the entire length of the shaft 10*b* (such as by simply twisting square bar stock), it will be understood upon reviewing the description that follows that the spiral may be provided along only a portion of the shaft 10*b* (preferably, in such case, along the tail end 10*c*, or otherwise away from the head end 10*a*). Alternatively, and especially in cases where the spiral shaft 10*b* is less than one foot in length, the pitch could instead be considered as the thread-to-thread spacing, as is conventional. Using this gauge, the thread-to-thread pitch is preferably greater than ⅞ths of an inch and, most preferably, about two inches (or, stated another way, the spiral repeats in the linear direction about every two inches).

Figure 2:
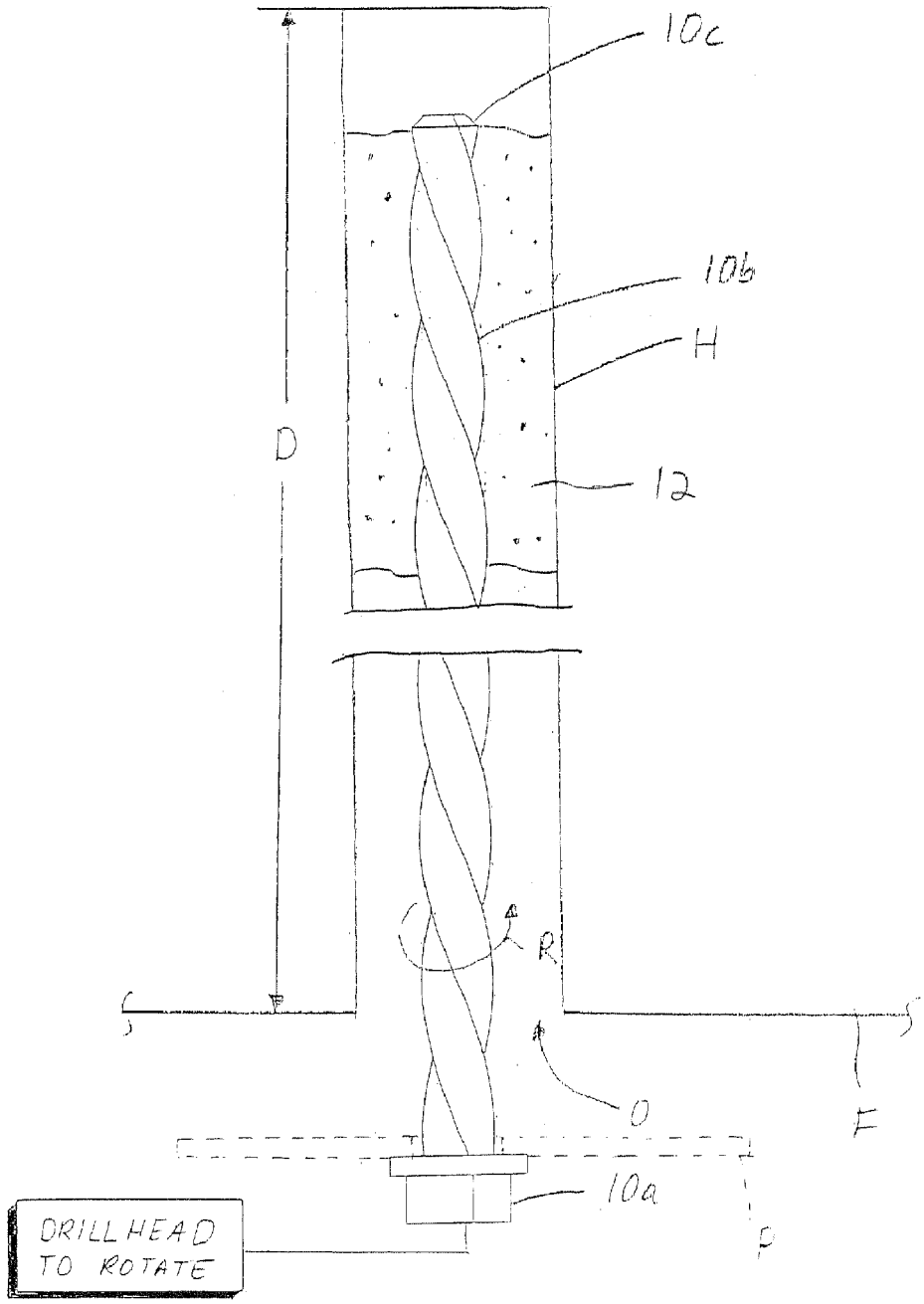
FIGS. 2-4 are schematic diagrams showing the manner in which the spiral bolt of FIG. 1 may be tensioned using a resin nut formed in the borehole.
Figure 3:
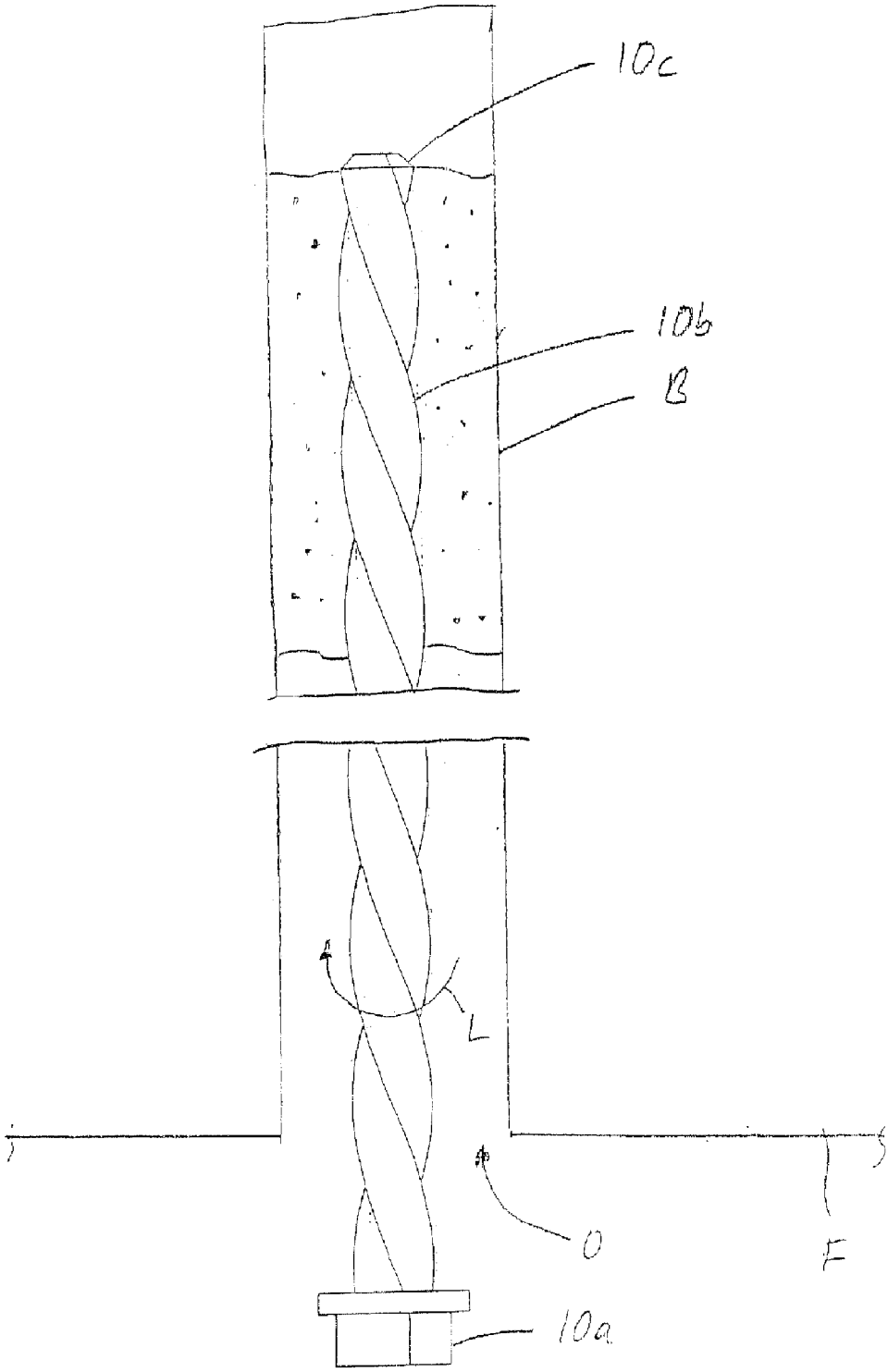

Reference is now made to FIG. 2, which although not drawn to scale, illustrates schematically the manner in which the bolt 10 of FIG. 1 is installed in the borehole H. Specifically, the tail end 10*c* of the bolt 10 is inserted through the opening O of the borehole H, which is preferably formed having a diameter close to the width M of the spiral shaft 10*b* (e.g., ¾" for a 1 inch diameter borehole). The borehole H also preferably has a depth D greater than at least the spiral shaft 10*b*, and preferably greater than the length of the entire bolt 10 (e.g., dimension B in FIG. 1) by at least one inch.

Using a lift boom associated with a bolting machine or like structure, the bolt 10 is advanced into the borehole H such that the head end 10*a* remains spaced from the adjacent face of the roof a distance equal to or slightly less than the excess depth D of the borehole H (e.g., about two inches). As shown in phantom in FIG. 2, a plate P is typically associated with the head end 10*a* of the bolt 10, and would thus also be spaced from the face F. However, once the bolt 10 is tensioned in the manner described below, this plate P engages the face F and compresses the associated strata (see FIG. 4).

Once the bolt 10 is partially inserted, uncured resin (also sometimes referred to as "grout") is provided adjacent at least a portion of the spiral shaft 10*b* in the associated annulus (which is shown in FIG. 2 as being greatly oversized for purposes of illustration, but is normally only about ⅛"-¼" on either side). Most preferably, the uncured resin occupies the annulus adjacent the tail end 10*c* of the bolt 10, and in the upper portion of the borehole H. Although the uncured resin may be provided from a remote source, such as by way of injection, it is most preferably supplied in the for of a frangible cartridge (not shown), or resin "sausage" in the vernacular. Typically, this type of cartridge is pre-installed in the borehole H and ruptured during insertion of the bolt 10, thus causing a quick-curing resin to occupy the surrounding borehole H. This "grout" usually comprises two materials (e.g., polyester resin and a catalyst paste) that make contact and react only upon the rupturing of the cartridge. Upon being thoroughly mixed, such as by the rotation of the bolt 10 within the borehole H, the resin then quickly hardens. The hardened resin or grout thus serves to hold the bolt 10 securely within the borehole H.

In accordance with another aspect of the invention, the bolt 10 with the spiral shaft 10*b* at least partially surrounded by uncured resin is rotated to effect the desired mixing and/or hardening, such as by using any conventional type of bolting machine. In the illustrated embodiment in which the spiral is left-handed in nature, the rotation is in the opposite, or right-handed, direction (see action arrow R in FIG. 2). Preferably, this rotation is done without simultaneously advancing the bolt 10 within the borehole H any significant amount, such that it remains spaced from the opening O of the borehole H.

As should be appreciated, this rotation in combination with the spiral shaft 10*b* serves to create a "pumping" action that substantially holds the uncured resin in place, and may possibly advance or "push" this resin deeper within the borehole H. In other words, the spiral shaft 10*b* of the bolt 10 may essentially function as an auger or screw with flights that maintain the resin at a particular location within the upper end of the borehole H. In any case, the rotation of the spiral shaft 10*b* preferably is such that it prevents the uncured resin from advancing toward the opening O of the borehole H to any significant degree. As a result of this pumping action, once the resin sets or cures (normally, after a period of rest post-mixing), it surrounds only a portion of the spiral shaft 10*b* within the borehole H. The amount of resin supplied will of course depend on the relative sizes of the spiral shaft 10*b* and the borehole H, but is preferably sufficient to cover about 12-18 inches of the shaft 10*b* adjacent the tail end 10*c* or otherwise away from the head end 10*a* (which, of course, still remains spaced from the opening O of the borehole H).

Once the resin sets or cures (which normally takes only seconds after mixing), a stationary, hardened resin "nut" 12 is thus formed around at least a portion of the spiral shaft 10*b* in the borehole H. As should be appreciated, this resin nut 12 has an internal thread matching the spiral thread of the adjacent shaft 10*b* and occupied by it. In the case of the left-handed spiral, the bolt 10 may be rotated in a direction opposite the first direction (note action arrow L) and in the same direction as the spiral. The engagement between the spiral shaft 10*b* and the resin nut 12 causes the bolt 10 to advance within the borehole H when so rotated, thus moving the head end 10*a* closer to the adjacent opening O. However, the hardened resin nut 12 remains stationary due to the peripheral contact with the sidewall of the borehole H.

This rotation may be completed until any associated engagement hardware, such as a plate P, is brought into secure engagement with the face F (which normally will take less than one complete turn). The appropriate amount of torque is then applied to ensure that the bolt 10 is fully tensioned and the strata compressed or anchored in the desired manner. As noted above, the depth D of the borehole H is made at least slightly greater than the overall length B of the bolt 10 such that the tail end 10*c* can freely advance and does not "bottom out" during the final advance caused by tensioning.

Numerous advantages may thus arise from the use of the above-described technique. First of all, the bolt 10 in the preferred embodiment may be made of only one piece of material, and need not include any expansion shells, external nuts, or surface working (e.g., fine threads cut into the surface of the bolt) in order to be effective. Accordingly, no parts require assembly "on-site." This not only substantially reduces the manufacturing cost, but also facilitates ease of installation and results in a stronger bolt.

Additionally, only partial grouting of the borehole is required for effectively practicing the present invention. Thus, substantially less grout is required, as compared to arrangements in which the borehole is fully grouted. A concomitant savings in material cost invariably results (possibly as much as 75%), as well as a reduction in the cost of transporting the grout into the mine and maintaining it in a "ready for use" state.

Figure 4:
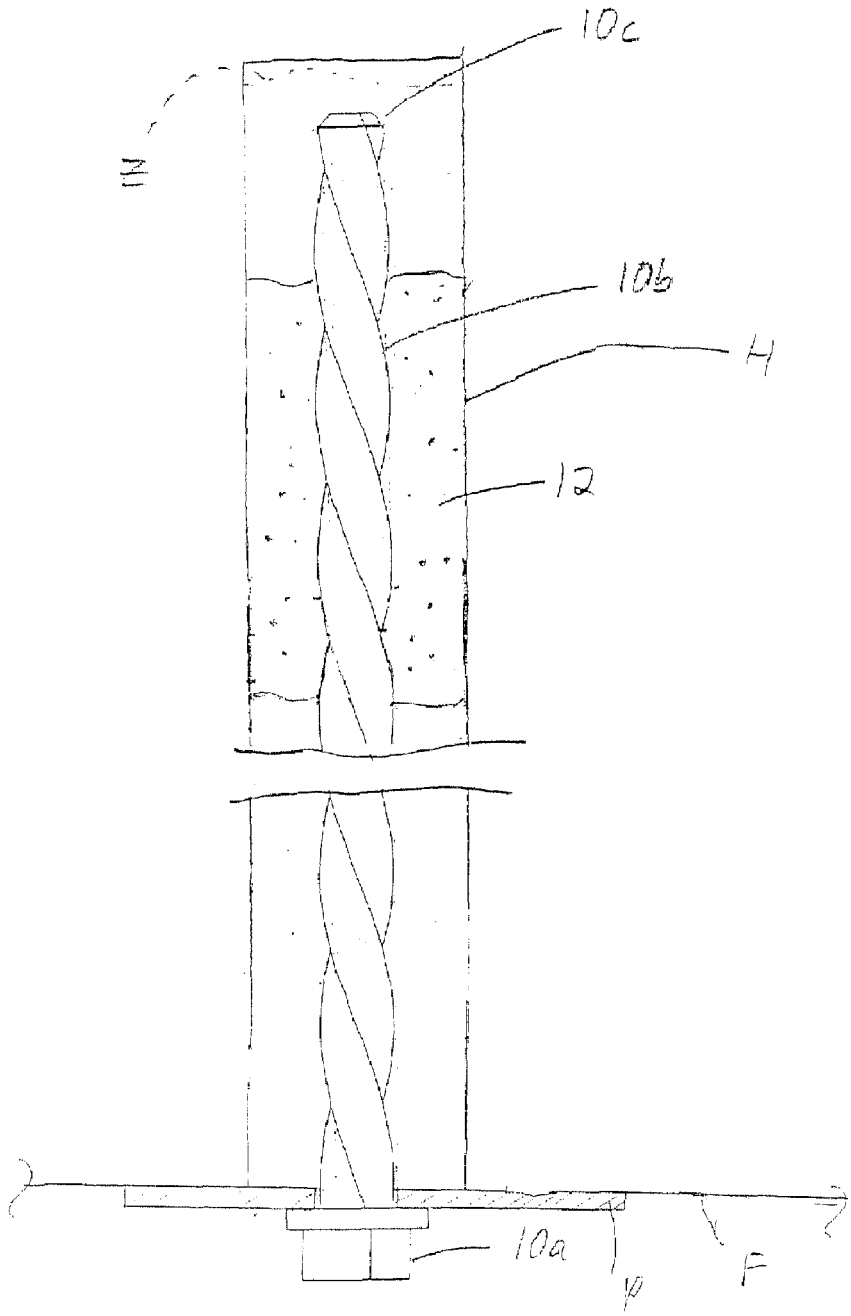

The completed installation of the bolt 10 also advantageously results in the head end 10*a* being positioned extremely close to face F of the mine roof (see FIG. 4). Thus, unlike prior arrangements in which an external nut is threaded onto an exposed shank projecting several inches from the face F, there is very little depending structure of the installed bolt 10 to engage a passing machine or person. This is especially important in narrow mine passages resulting from a low seam height. Moreover, since essentially the entire shaft 10*b* of the bolt 10 is drawn into the borehole H, the overall appearance of the face F is more regular and aesthetically pleasing.

Finally, aside from being one piece, the bolt 10 can be manufactured in a relatively easy and inexpensive manner. Standard square bar stock of any suitable width dimension (e.g., ½", ⅝", or ¾" for a 1" borehole) can simply be forcibly twisted to the desired pitch (whether considered twists per foot, or thread-to-thread spacing) to form the shaft 10*b*. The head end 10*a* is typically forged. Conveniently, the twisting can also be completed on a relatively long piece of stock, which can then be cut into lengths corresponding to the shaft 10*b* of the bolt 10.

During manufacturing, the twisting of the bar (which is typically made of steel) may result in the elimination of the exterior surface oxide layer, or "scale," created during the hot roll process. The absence of the scale allows faster oxidation of the bar, especially when the bolt 10 is stored outdoors and exposed to the elements during the period between manufacturing and ultimate use in the mine. Any deterioration of the surface may inhibit the ability of the shaft 10*b* to turn freely within the resin nut 12 during installation.

To ameliorate any such problem, it is possible to coat at least part of the spiral shaft 10*b* (such as the uppermost portion) after manufacture with either a lubricity agent or a rust-inhibiting agent, or both. The partial or full application of such agent(s) is anticipated to ease the installation by allowing the spiral shaft 10*b* to rotate more freely relative to the resin nut 12 during tensioning. Providing any coating agent with a coloring (e.g., a yellow pigment) is also contemplated. As a result, the installer may not only ensure that the coating remains present on an appropriate portion of the shaft 10*b*, but also can readily differentiate the spiral bolts 10 for use in the present method from others.

During installation, it may also sometimes result that the resin cures not only along a portion of the spiral shaft 10*b*, but also within the portion of the borehole H into which the bolt 10 must advance during tensioning (see dashed line Z in FIG. 4). Although this does not preclude installation, it may be helpful to make the tail end of the bolt 10 with a point or taper, as shown. This will help it advance within the resin nut 12, if such is necessary.

Although the pitch of the spiral may be varied, it is also desirable to ensure that the spiral bolts 10 for use in a common installation are consistent. This keeps the installation torque required consistent. Likewise, the spiral shaft 10*b* should also be consistent to facilitate its movement through the resin nut 12 once formed. The pitch of the spiral is also preferably such that there is noticeable movement of the head end 10*a* toward the opening O of the borehole H during installation, thus giving the installer a visual cue that the process is proceeding as expected.

The use of conventional types of washers, such as those made of, or coated, with TEFLON or other anti-friction types, is also possible between the head end 10*a* (or flange 11) and any associated structure (such as plate P). However, it is believed that the use of such anti-friction washers is less important with this type of arrangement than with conventionally threaded bolts, since conventionally threaded bolts require many revolutions for installation, resulting in greater friction and heat, and less effective tension/torque ratios.

The foregoing description of embodiments of the present invention has been presented for purposes of illustration and description. It is not intended to be exhaustive or to limit the invention to the precise form disclosed. Obvious modifications or variations are possible in light of the above teachings. The present embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention.

The invention claimed is:

1. An apparatus for installation in a borehole formed in a face of a mine passage, comprising:

an elongated bolt including a proximal end having a fixed head, a distal end without an attachment, and a spiral shaft portion for positioning in the borehole; and a stationary, hardened resin nut formed in a portion of the borehole, said resin nut including an internal thread extending continuously along the entire length of the resin nut, said continuous thread surrounding at least part of the spiral shaft portion of the bolt.

2. The apparatus of claim 1, wherein the spiral shaft portion comprises a generally square cross section.

3. The apparatus of claim 1, wherein the spiral shaft portion includes approximately 1-2 twists for about every foot in the longitudinal direction.

4. The apparatus of claim 1, further including a lubricity agent applied along at least part of the spiral shaft portion for contacting the resin nut.

5. The apparatus of claim 4, wherein a colored agent is applied along at least part of the spiral shaft portion.

6. The apparatus of claim 1, wherein the distal end of the bolt comprises a taper or point.

7. The apparatus of claim 1, wherein the bolt comprises one piece of material and further includes a flange adjacent the head end.

8. The apparatus of claim 1, wherein at least a portion of the bolt within the stationary, hardened resin nut has a substantially constant transverse dimension.

9. The apparatus of claim 1, wherein the resin nut extends along only the spiral portion of the bolt.

10. An apparatus for installation in a borehole having a proximal opening and a distal end formed in a face of a mine passage, comprising:

an elongated bolt including a portion for positioning in the borehole;

a stationary, hardened resin nut having an internal thread extending continuously along the entire length of the resin nut for receiving the portion of the bolt; and means for rotating the bolt relative to the hardened resin nut.

11. The apparatus of claim 10, wherein the means for rotating the bolt comprises a drill head.

12. The apparatus of claim 10, wherein the portion of the bolt comprises a spiral portion.

13. In a borehole formed in a face of a mine passage for receiving a bolt having an elongated shaft for extending into the borehole, the improvement comprising a resin nut formed in a portion of the borehole and having an internal thread extending continuously along the entire length of the resin nut.

14. The invention of claim 13, wherein the shaft of the bolt is spiral, whereby rotating the spiral shaft relative to the internal thread serves to tension the bolt.

15. A method of providing support for tensioning a bolt including a spiral shaft portion in a borehole formed in a face of a mine passage, comprising:

inserting resin and a bolt including a spiral shaft portion in the borehole, the bolt having a distal end spaced from an upper, distal end of the borehole and a proximal end spaced from an open, proximal end of the borehole;

forming a stationary, hardened resin nut having an internal thread extending continuously along the length of the resin nut along the spiral shaft portion of the bolt; and rotating the spiral shaft portion relative to the resin nut to thread the spiral shaft portion along the continuous internal thread of the resin nut and advance the proximal end of the bolt toward the open end of the borehole.

16. The method of claim 15, wherein the inserting step comprises:

providing uncured resin within the borehole adjacent the spiral shaft portion of the bolt;

and further including the steps of rotating the bolt in a first direction to substantially maintain the resin adjacent the spiral shaft portion; and allowing the resin to substantially cure and form the hardened resin nut before the step of rotating the spiral shaft portion relative to the resin nut to move the spiral shaft portion along the continuous internal thread of the resin nut and advance the bolt within the borehole.

17. The method of claim 16, wherein the step of rotating the spiral shaft portion comprises rotating the bolt in a second direction opposite the first direction upon the substantial curing of the resin.

18. The method of claim 15, further including the step of applying a lubricity agent to at least part of the spiral shaft portion.

19. A method of installing an elongated bolt having a head end and a threaded or spiral portion in a face of a mine passage having a borehole with an opening adjacent the face, comprising:

inserting the bolt at least partially within the borehole with the head end spaced from the opening;

rotating the bolt in a first direction and at least partially within an uncured resin within the borehole;

allowing the resin to substantially cure and form a nut having a continuous internal thread extending continuously along the entire length of the resin nut; and rotating the bolt in a second direction opposite the first direction such that the bolt moves through the resin nut with the head end moving closer to the opening of the borehole.

20. The method of claim 19, wherein the step of rotating the bolt in the second direction advances the head end of the bolt toward the open end of the borehole.

21. A method of installing an elongated bolt having a spiral portion in a face of a mine passage including a borehole, comprising:

inserting the bolt at least partially within the borehole;

rotating the bolt at least partially within an uncured resin within the borehole;

allowing the resin to substantially cure and form a nut having an internal thread extending continuously along the entire length of the resin nut; and rotating the bolt for movement such that the spiral portion moves relative to the resin nut along the continuous internal thread to provide support for the face of the mine passage.

22. The method of claim 21, wherein the step of rotating the bolt at least partially within the uncured resin is done in a first direction, and the step of rotating the bolt for movement relative to the resin nut is done in a second direction opposite the first direction.

23. In a mine passage including a face having a borehole formed therein, an apparatus for providing support for the face including an elongated bolt including a spiral shaft portion for positioning in the borehole without an attachment at the distal end thereof, the improvement comprising:

a stationary, hardened resin nut formed in a portion of the borehole having an internal passage therethrough extending continuously from a proximal end of the resin nut to a distal end of the resin nut having a substantially constant transverse dimension surrounding at least part of the spiral shaft portion of the bolt;

whereby rotation of the spiral shaft portion with the internally threaded passage of the resin nut serves to advance the bolt within the borehole.

24. An apparatus for installation in a borehole formed in a face of a mine passage, comprising:

an elongated bolt including a spiral shaft portion for positioning in the borehole; and a stationary, hardened resin nut formed in a portion of the borehole, said resin nut including an internal thread extending continuously along a length of the resin nut, said length of said resin nut surrounding at least first part of the spiral shaft portion of the bolt while leaving a second part of the spiral shaft portion exposed.

25. A method of providing support for a face of a mine passage, comprising:

positioning uncured resin and a bolt including a spiral shaft portion in a borehole formed in the face of the mine passage;

allowing the resin to harden to form a stationary, hardened resin nut along a first length of the bolt including at least part of the spiral shaft portion of the bolt; and rotating the bolt relative to the resin nut to thread a second length of the spiral shaft portion proximal to the first length through the resin nut and advance the bolt within the borehole.

* * * * *